United States Patent [19]

Hiatt et al.

[11] 4,288,955

[45] Sep. 15, 1981

[54] STRUCTURAL BUILDING ELEMENT

[76] Inventors: Carl C. Hiatt, 2500 Roxbury La., Fort Smith, Ark. 72903; Nils L. Larson, 7837 Reynolda Sta., Winston-Salem, N.C. 27109

[21] Appl. No.: 45,681

[22] Filed: Jun. 5, 1979

Related U.S. Application Data

[63] Continuation of Ser. No. 849,510, Nov. 7, 1977, abandoned, and a continuation-in-part of Ser. No. 625,478, Oct. 24, 1975, Pat. No. 4,056,910.

[51] Int. Cl.[3] ..... E04B 5/00

[52] U.S. Cl. ..... 52/309.1; 52/98; 52/600

[58] Field of Search ..... 52/600, 309.1, 98, 202, 52/405, 415, 562, 576, 596, 601–613; 428/119, 310, 413

[56] References Cited

U.S. PATENT DOCUMENTS

| | | | |
|---|---|---|---|
| 641,304 | 1/1900 | Lazendoerfer | 52/415 |
| 1,968,393 | 7/1934 | Henderson | 52/98 |
| 2,292,085 | 8/1942 | Powell | 52/98 |
| 3,284,980 | 11/1966 | Dinkel | 52/600 |
| 3,654,742 | 4/1972 | Wilnau | 52/744 |
| 3,922,413 | 11/1975 | Reineman | 52/405 X |
| 4,056,910 | 11/1977 | Hiatt et al. | 52/309.1 X |

FOREIGN PATENT DOCUMENTS

| | | | |
|---|---|---|---|
| 546676 | 7/1956 | Italy | 52/98 |
| 546763 | 8/1956 | Italy | 52/612 |
| 203307 | 6/1939 | Switzerland | 52/612 |

OTHER PUBLICATIONS

Architectural Record, "Shaded Walls Proposed To Cut Solar Heat", Aug. 1961, pp. 145–147.

*Primary Examiner*—J. Karl Bell

*Attorney, Agent, or Firm*—Schwartz, Jeffery, Schwaab, Mack, Blumenthal & Koch

[57] ABSTRACT

A structural building element in the form of a panel, block or related configuration having a continuous phase of cementitious material which includes an interconnected matrix having a first density and a plurality of zones dispersed within the matrix, wherein the zones have a second density lower than the first density. Reinforcement members may be embedded within portions of the interconnected matrix to impart additional strength to the element.

26 Claims, 18 Drawing Figures

Fig. 1.
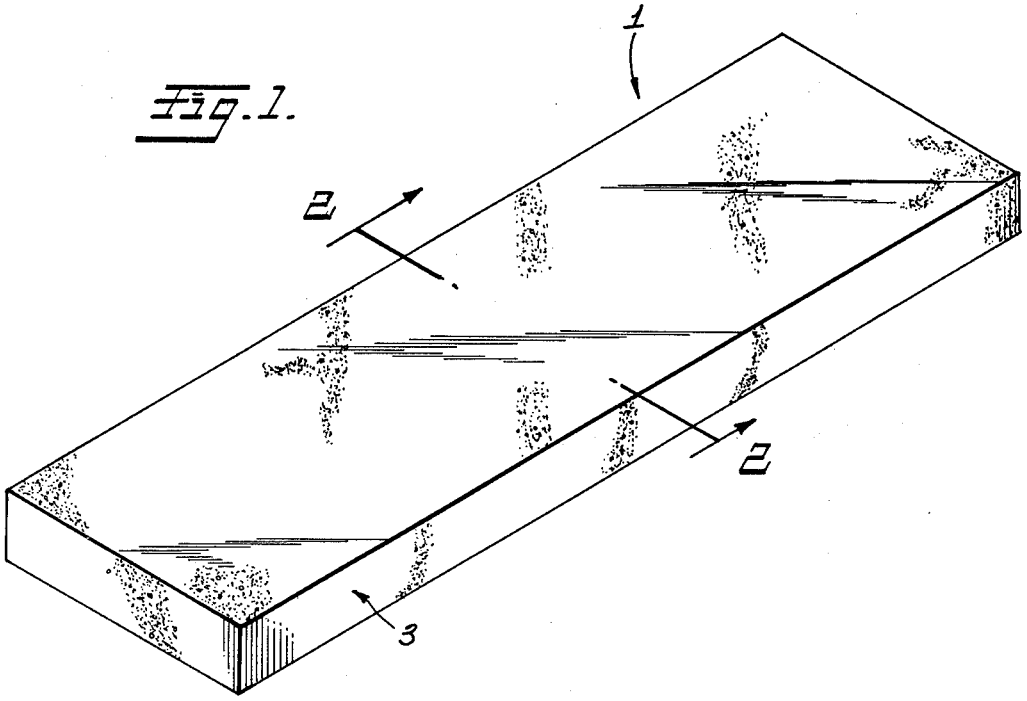
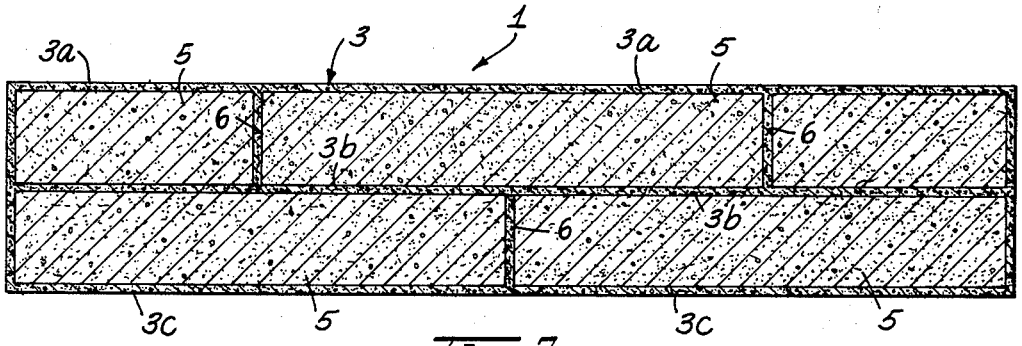
Fig. 2.

Fig. 3.
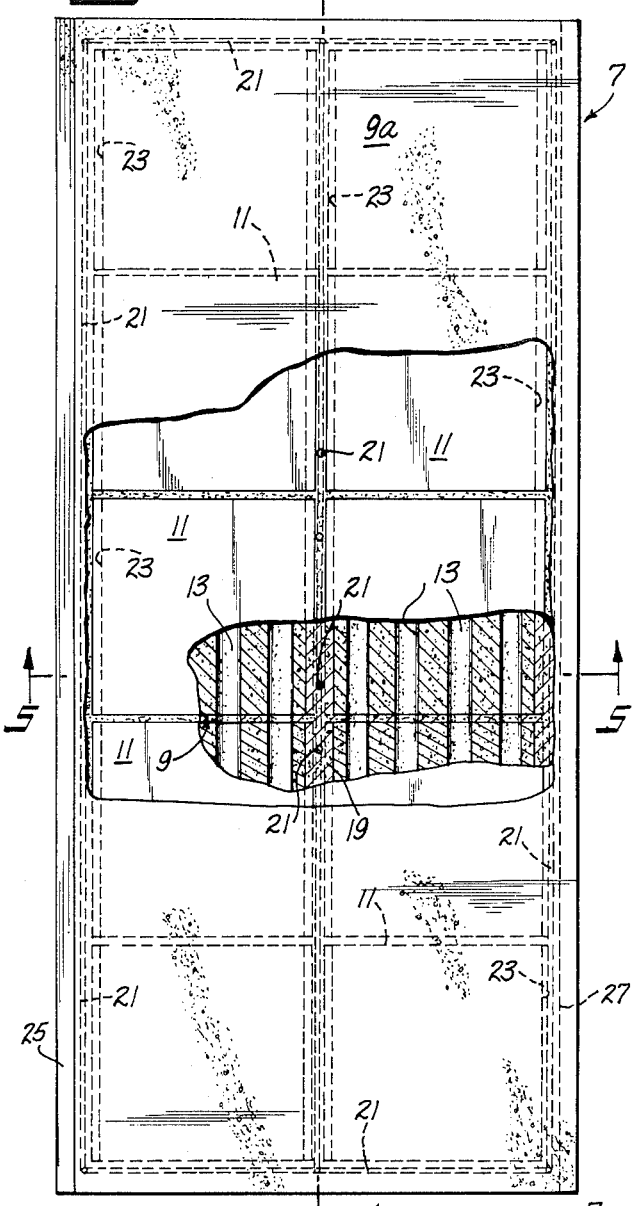
Fig. 4.
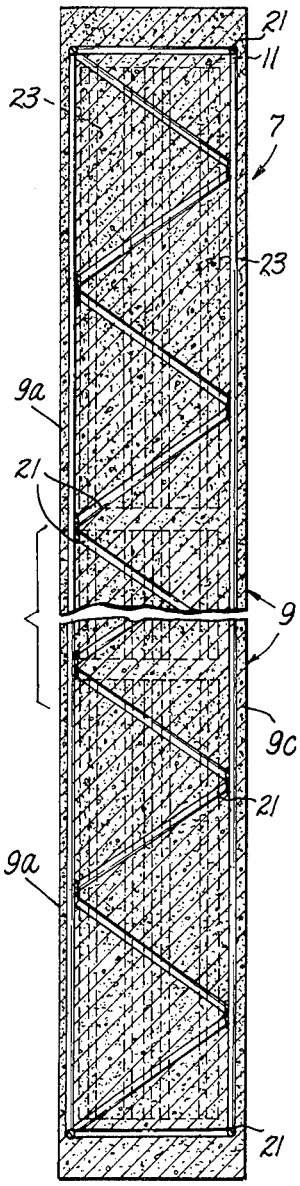
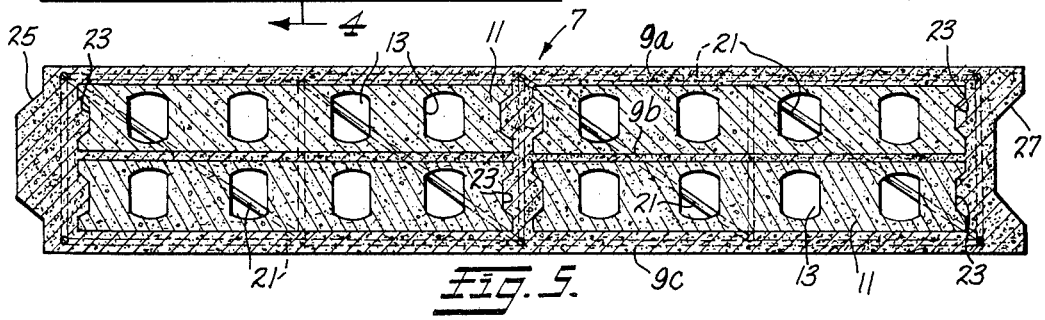
Fig. 5.

Fig. 6.
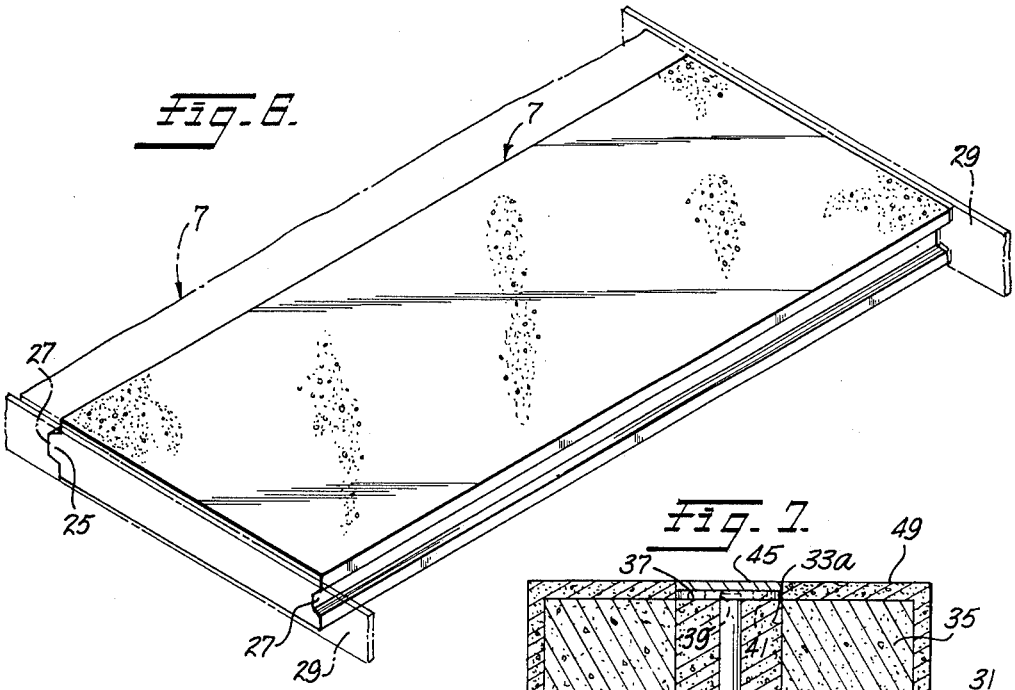
Fig. 7.
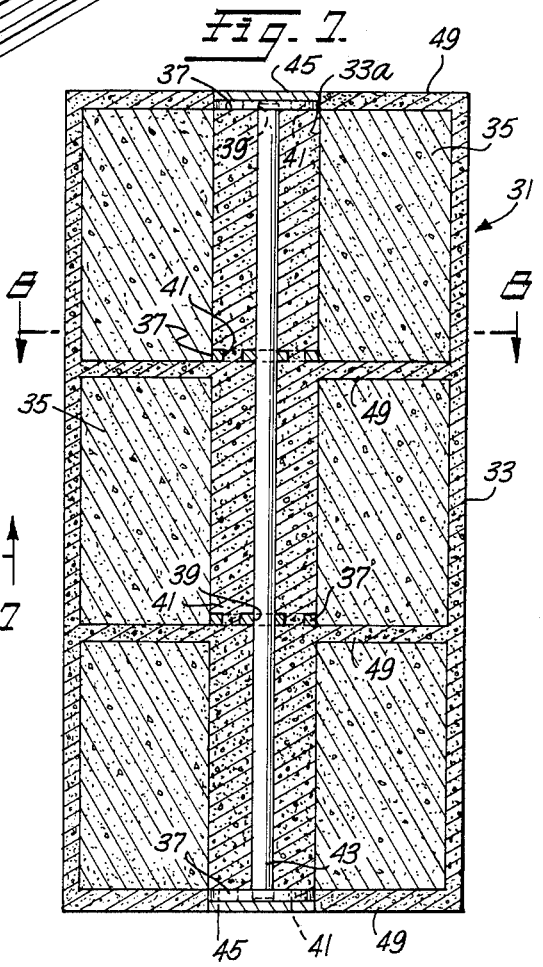
Fig. 8.
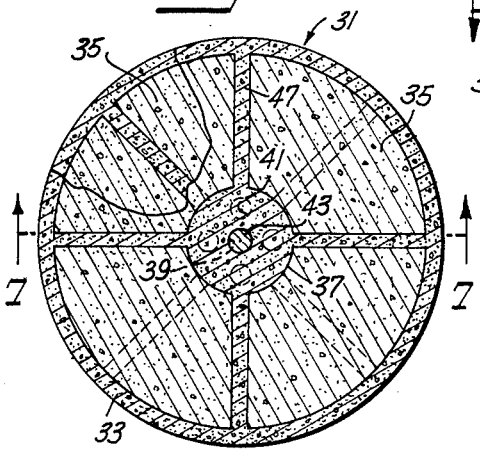
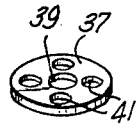
Fig. 9.

STRUCTURAL BUILDING ELEMENT

CROSS-REFERENCE TO RELATED APPLICATION

This is a continuation of application Ser. No. 849,510, filed Nov. 7, 1977, now abandoned, and a continuation-in-part of Application Ser. No. 625,478 filed on Oct. 24, 1975 and now U.S. Pat. No. 4,056,910.

BACKGROUND OF THE INVENTION

1. Field of the Invention

This invention generally relates to the field of art which includes materials and structural elements or components for use in the building or construction industry. More particularly, this invention relates to a structural building element in the form of a panel, block or related shape which is particularly useful for constructing wall, floor, ceiling and/or column systems.

2. Description of the Prior Art

The prior art is replete with many forms of building or construction elements which are used to form a larger structure. Such elements may take the form of sheets, panels, blocks or columns and may be made from a variety of materials. For example, a building panel may be formed entirely from pre-cast concrete or similar cementitious material. Such a panel might also be made from a combination of cementitious material provided with internal reinforcements, such as wood or metal rods. It has also been suggested that building panels or elements may be made from various combinations of organic plastic compositions and materials.

As is evident, known building elements or panels made substantially of concrete and related cementitious materials are quite strong under compressive loading, but are difficult to handle because of their heavy weight and further do not provide good insulative qualities. The prior art attempts at utilizing organic plastics, wood and other lightweight materials for making building elements have resulted in products which possess improved insulative qualities over their concrete or cementitious counterparts, but do not begin to exhibit the compressive loading strengths inherent with the latter.

SUMMARY OF THE INVENTION

It is therefore an object of the present invention to provide an improved building element which possesses a high degree of compressive strength.

It is another object of the present invention to provide a building element which is light in weight and easily handled or manipulated.

It is a further object of the present invention to provide a building element which is characterized by good thermal and acoustical insulating qualities.

It is yet a further object of the present invention to provide for an improved building panel which is simple in construction and economical to manufacture.

The present invention serves to overcome the disadvantageous characteristics of prior art building elements and to achieve the foregoing objects by providing a building element formed entirely of a continuous phase of cementitious material, whereby the continuous phase includes an interconnected matrix having a first density which substantially completely surrounds a plurality of lower density zones dispersed within the matrix. The matrix is formed from a composition which includes cementitious material and a discontinuous phase of discrete particles, fibers or related additives which provide the matrix with a cumulative average high density. The zones dispersed within the matrix are comprised of cementitious material having dispersed therein a discontinuous phase of discrete particles, fibers or related structures of materials which provide the zones with a cumulative average low density. The element of the present invention may assume a variety of structural shapes, such as block, planar or columnar, and may further be provided with additional reinforcing members embedded within the matrix portion of the element.

Other objects, features and advantages of the present invention will be apparent from the following description of specific embodiments thereof, with reference to the accompanying drawings, which form a part of this specification, wherein like reference characters designate corresponding parts of the several views.

BRIEF DESCRIPTION OF THE DRAWINGS

In the Drawings:

FIG. 1 is an isometric view of a building element of the present invention;

FIG. 2 is an enlarged transverse sectional view, through the element of FIG. 1, taken on the line 2—2 thereof;

FIG. 3 is an enlarged plan view of another embodiment of the building element of the present invention, partly broken away to show the internal structure;

FIG. 4 is an enlarged fragmentary longitudinal section view, taken on the line 4—4 of FIG. 3;

FIG. 5 is an enlarged transverse sectional view, taken on the line 5—5 of FIG. 3;

FIG. 6 is an isometric view of the building element of FIG. 3 shown in a partially assembled condition, with the adjacent structure being depicted in phantom lines for purposes of clarity;

FIG. 7 is a vertical sectional view showing yet another embodiment of the building element of the present invention;

FIG. 8 is a horizontal sectional view, taken along the line 8—8 of FIG. 7, partly broken away to depict the structure of the element at a lower level;

FIG. 9 is a perspective view of one of the structural components utilized in the building element shown in FIGS. 7 and 8;

DETAILED DESCRIPTION OF PREFERRED EMBODIMENTS

Figure 10:
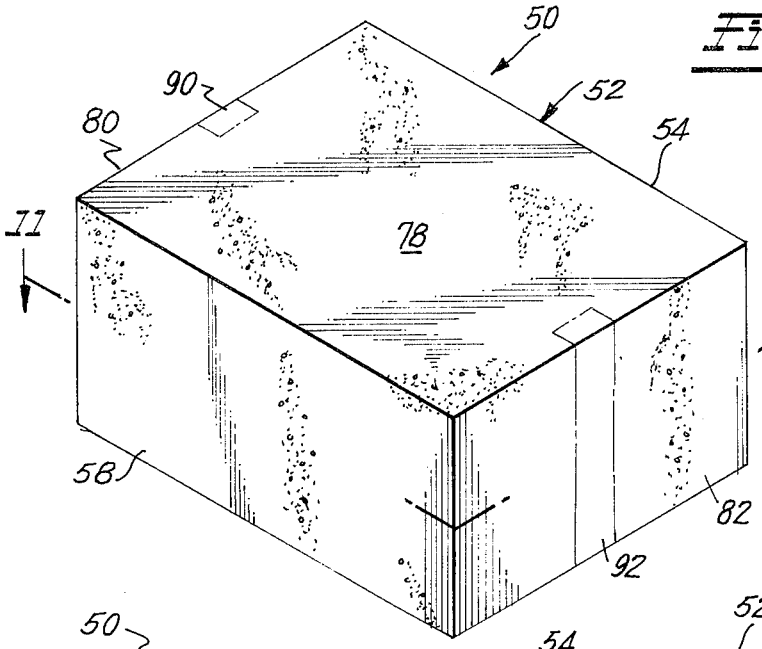
FIG. 10 is an isometric view of still another embodiment of the building element of the present invention.

Referring now to FIGS. 1 and 2 of the drawings, there is depicted an embodiment of the building element of the present invention in the form of a panel 1 having a relatively flat or planar configuration. Panel 1 includes an interconnected matrix 3 which completely surrounds and encloses a plurality of zones 5 embedded therein. As indicated in FIG. 2, the general planar structure of panel 1 is effectively provided with three continuous matrix layers 3*a*, 3*b* and 3*c*, which layers extend to the extremities of panel 1. Matrix 3 is comprised basically of inorganic cementitious material such as Portland cement based compositions, concrete, various compositions of hydraulic cement or any other such related material having a cement base. Examples of such suitable cementitious materials are disclosed in the text "Manual of Lathing and Plastering" by John R. Diehl, A.I.A., and include calcined gypsum, hydrated lime, Portland cement and admixtures thereof. Matrix 3 is also provided with a discontinuous phase or dispersion of discrete additives in the form of aggregates, particles, fibers or related such structures well known in the art for the purpose of strengthening the cementitious base of matrix 3 and providing the desired cumulative average density. Such additives may be in the form of inorganic aggregate particles, including sand, stone, marble, rock, expanded clay and other related materials well known in the art. Also, both organic and inorganic fibers, such as those derived from plastics, glass, asbestos, and metal, may also be utilized as additive material dispersed throughout matrix 3. It is further to be understood that any combinations or mixtures of the aforementioned additives may also be utilized to advantage in deriving the overall composition of matrix 3. However, because of the desirability of imparting hardness and strength to matrix 3, it is appropriate that the cumulative average density of matrix 3, including cementitious material and additives, be within the inclusive range of from 60 to 200 pounds per cubic foot, with a preferred density of matrix 3 being within the inclusive range of 90 to 150 pounds per cubic foot.

As seen in FIG. 2, zones 5 comprise generally rectangular-shaped cross sections of material surrounded by matrix 3. However, it is understood that zones 5 may assume any suitable configuration, even free form, with the only requirement for the embodiment depicted in FIGS. 1 and 2 being that zones 5 are individually substantially entirely surrounded and enclosed within interconnected matrix 3. Matrix layers 3*a*, 3*b* and 3*c* serve to generally divide zones 5 into two tiers, spaced by a plurality of vertical walls 6, and separated by continuous central matrix layer 3*b*. By virtue of this layered arrangement, great compressive strength is imparted to overall panel 1. Though the tiers of zones 5 are depicted as rather uniform or regular staggered sections of blocks, it is to be understood that any desired arrangement or configuration of zones 5 is suitable for the practice of the present invention in a building element having a generally planar configuration. A significant aspect of such a planar configuration is the provision of at least a continuous matrix layer 3*b* disposed substantially centrally along the longitudinal axis of the element.

Like matrix 3, zones 5 are basically formed from a cementitious material, which material may comprise the same constituents or compositions as previously indicated for matrix 3. Since zones 5 are not subjected to the direct application of external stress as is the case of matrix 3, it is desirable that zones 5 be of a lower density such that the entire panel 1 shall have a correspondingly lower weight. To this end, zones 5 include additives in the form of a discontinuous phase or dispersion of discrete particles which, when considered cumulatively with the cementitious material in which it is dispersed, will provide an appropriate density range inclusive of from 10 to 50 pounds per cubic foot. The preferred density of zones 5 is of the range inclusive from 18 to 35 pounds per cubic foot. In order to achieve the lower density of zones 5, the cementitious material comprising the basic thereof may include additive material in the form of discrete particles having a relatively light weight, for example perlite, vermiculite, polymeric materials and mixtures thereof. The polymeric materials may advantageously be comprised of expandable or foamable particles derived from polyurethane, polystyrene polyolefin or similar such resins. Further, plastic or polymeric materials of the non-foamable or non-expandable type may also be utilized to advantage.

Because of the similar cementitious material utilized as the basis of the composition for matrix 3 as well as that of zones 5, panel 1 can thus be defined as an integral and continuous phase of cementitious material. Notwithstanding variation between the average densities of higher density matrix 3 and lower density zones 5, by virtue of the different additive materials incorporated therein, matrix 3 is rigidly and strongly bound to zones 5 and vice versa by virtue of the cementitious material being common to both. This unique relationship of materials results in panel 1 having an extremely high degree of compressive strength, based primarily upon the interconnected high density matrix 3 which produces a cellular structure that exhibits good load absorption characteristics. Thus, when a load is applied to panel 1, the energy of compression and bending of matrix 3 is absorbed by zones 5, thereby permitting panel 1 to be subjected to stress conditions that would normally cause failure of known concrete or cement panels. Such strength characteristics of panel 1 make it particularly useful and safe for buildings in earthquake prone locations.

Panel 1 is also characterized by comparatively light weight, when compared to prior art panels made of concrete or cement, by virtue of zones 5 having a comparatively low average density because of the discrete lightweight particles dispersed therein. Accordingly, the preferred cumulative average density of panel 1 is of a range inclusive from 20 to 200 pounds per cubic foot. As is therefore evident, a building element constructed according to the present invention can be varied greatly in overall weight in order to accommodate its desired manner or environment of use.

Further, if panel 1 is to be utilized in an environment whereby a face thereof is to be exposed to the exterior, such as in a wall of a building, the matrix portion so exposed may include a larger amount of additive material in the form of rock or aggregate particles so that it will have maximum physical resistance to varying and extreme weather conditions. Similarly, should it be desired that a face of panel 1 be utilized as an interior wall of a building or the like, the portion of matrix 3 forming such an interior face may include additive material comprising a greater amount of, or be entirely of, organic or inorganic fibers since the interior face will not be subjected to harsh weather conditions or other severe structural abuse, thereby reducing the overall weight of panel 1. It is clearly understood that the respective additive materials utilized in both matrix 3 and zones 5 may be varied in composition and amount throughout the entire panel 1 if such variation is deemed desirable or necessary.

Referring now to FIGS. 3 through 5, there is depicted another embodiment of the building element of the present invention. In this embodiment, the element is also in the form of a panel 7 which includes an interconnected higher density matrix 9 and a plurality of lower density zones or blocks 11 dispersed within and surrounded by matrix 9. The compositions of matrix 9 and blocks 11 may be the same as that previously indicated for matrix 3 and zones 5, respectively, of the embodiment depicted by FIGS. 1 and 2. As similarly indicated for panel 1 of FIGS. 1 and 2, panel 7 also includes three continuous spaced matrix layers 9*a*, 9*b* and 9*c* which serve to enclose and divide blocks 11 into two separate tiers. Central matrix layer 9*b*, extending transversely and longitudinally to the extremities of panel 7 serves as the foundation for the great compressive strength of panel 7.

As seen more clearly in FIGS. 3 and 5, blocks 11 are of substantially rectangular-shape and have voids 13 provided therethrough. Blocks 11 are disposed in linear parallel array along the longitudinal axis of panel 7 such that voids 13 of adjacent blocks are aligned to form a series of parallel channels 15 throughout the length of panel 7, as clearly depicted in the cut-away section of FIG. 3. The number of channels 15 formed in panel 7 according to this manner will vary with the number of voids 13 provided in each individual block 11. If desired, only one such channel 15 may be provided in the entire panel or a parallel series of channels may be formed as shown in FIGS. 3 and 5. Channels 15 may be utilized to receive electrical wiring, cables or conduits if panel 7 is employed in the construction of a building or similar structure. Voids 13 may be filled with insulation material to better control thermal and acoustical transmissions through panel 7. Also, voids 13 may be used for reducing substantially the weight of individual blocks 11, thereby serving to lighten the overall weight of panel 7. To this latter end, it is entirely possible that voids 13 in blocks 11 may be provided as needed for purposes of weight reduction and, as such, it would not then be necessary to align voids 13 to form continuous channels 15.

As seen in FIG. 3, matrix 9 of panel 7 substantially completely encloses and surrounds blocks 11 with the exception of the portions of spaces 17 between adjacent blocks where voids 13 are aligned to form channels 15. For added overall strength, a continuous section of matrix 9 is disposed substantially along the longitudinal axis of panel 7, as indicated at 19, to still further increase the overall strength and rigidity of panel 7. For even further strengthening of panel 7, reinforcing members 21 in the form of metal rods may be dispersed and embedded within matrix 9 along the outer peripheral edge of the panel as well as through the portion of matrix 9 disposed along the longitudinal axis of the element as indicated at 19. In order to assure a strong cementitious bond between matrix 9 and blocks 11, the latter may be provided with grooves 23 along the edge portions thereof, thereby affording a greater surface area for bonding. It is to be understood that panel 7 may also be reinforced by any well known reinforcement materials or members well known in the art for this purpose. For example, instead of rods 21, matrix 9 may be embedded with reinforcing members in the form of mesh structures, truss structures, pre-stressed metallic cables, or similar systems and devices well known in the art for this purpose.

Panel 7, as seen in FIG. 5, may also be provided with a male tongue or ridge 25 and a corresponding female groove or channel 26 along its opposite longitudinal edges for the purpose of facilitating the interlocking or adjacent panels together, as shown in FIG. 6. Both tongue 25 and groove 27 serve to facilitate the handling and manipulation of panel 7 during construction use. Wood plates 29 may also be utilized to secure the upper or lower portions of adjacent panels together in wood construction environments.

FIGS. 7 and 8 depict yet another embodiment of the building element of the present invention. In this case, the element is in the form of a column 31. Though column 31 is depicted as having a generally circular cross section, it is to be understood that any other cross-sectional configuration or design, such as triangular, rectangular, square or the like, may be utilized according to the desires and needs of any given application of the present invention.

As in the case of the two earlier described embodiments, column 31 comprises a third embodiment which also includes an interconnected higher density matrix 33 which surrounds and encloses a plurality of lower density zones 35. The compositions, materials and densities of matrix 33 and zones 35 are the same as those indicated for the earlier described embodiments.

Disposed substantially centrally and along the longitudinal axis of column 31 is a continuous and relatively thick portion of matrix 33, as indicated at 33*a*. Spaced centrally along the length of matrix 33*a* are a plurality of apertured washers 37. As depicted in FIG. 9, each washer 37 may be of circular configuration and provided with a central aperture 39 and a plurality of circumferential apertures 41 surrounding aperture 39. A steel reinforcing rod 43 may be passed through the aligned central apertures 39 of washers 37 to impart additional strength and rigidity to column 31. Washers 37 are securely held in place within matrix 33*a* which becomes embedded through circumferential apertures 41. Outermost washers 37, located at the outer ends of column 31, may be covered by correspondingly shaped solid metal plates 45 which are sealed and secured in place by means of matrix 33.

As seen in FIGS. 7 and 8, lower density zones 35 may assume the configuration of generally arcuate sections surrounded on all sides by a plurality of internal vertical walls 47 and a plurality of horizontal walls 49 of matrix 33, in addition to central matrix 33*a* and the outer cylindrical wall portion of matrix 33. In this structure, vertical walls 47 may be spaced 90° apart in successive vertical tiers separated by horizontal walls 49. However, adjacent tiers of vertical walls 47 may be offset from each other by 45° as indicated in the cut-away section of FIG. 8 to further increase the overall compressive strength of column 31.

Figure 11:
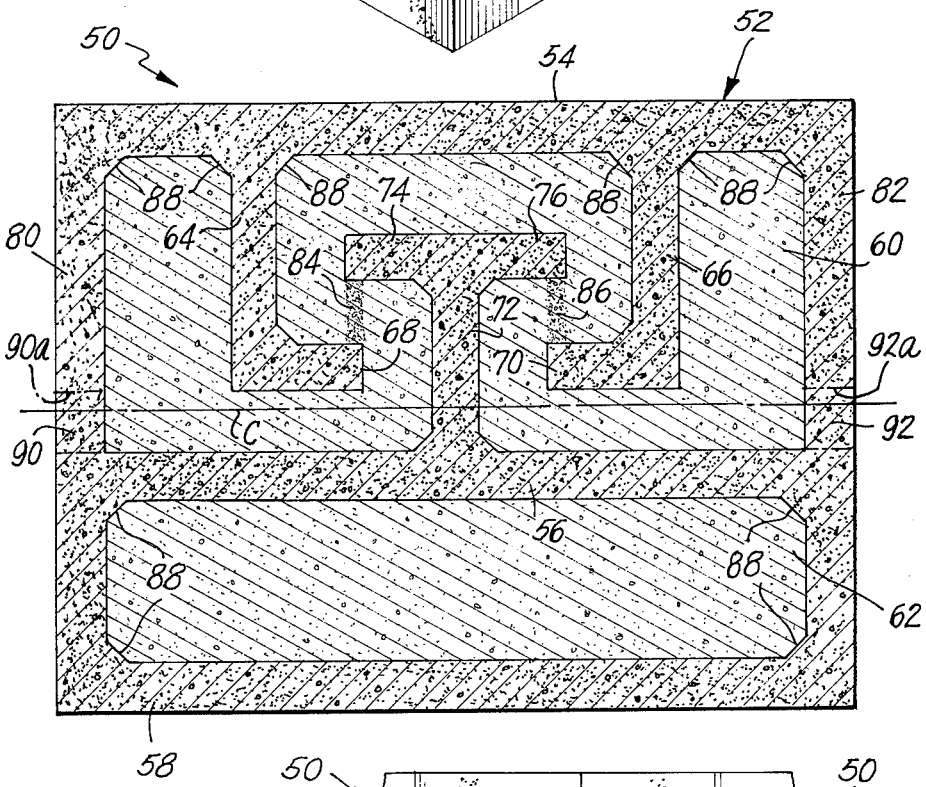
FIG. 11 is a horizontal sectional view taken along the line 11—11 of FIG. 10.

Referring now to FIGS. 10 and 11, there is shown still another embodiment of the present invention. In this embodiment, the building element is in the form of a rectangular-shaped block 50 that is provided with a continuous outer wall structure 52 of high density matrix material. As in the case of panel 1 and panel 7 of the former embodiments, matrix 52 includes three continuous spaced layers 54, 56 and 58, with such layers serving to collectively define a pair of separate and independent sections 60 and 62 of low density material.

Matrix layer 54 comprises a back exterior wall of block 50 and is provided with a pair of internal reinforcing lateral sections 64 and 66 integrally formed therewith. Lateral sections 64 and 66 extend inwardly from wall 54 and terminate short of opposing matrix layer 56, the latter comprising an interior wall of block 50. The free ends of lateral sections 64 and 66 terminate in substantially L-shaped single flanges 68 and 70, respectively. Flanges 68 and 70 may be directed in opposite directions towards each other.

Wall 56 includes an integrally formed internal reinforcing plate section 72 extending away therefrom and terminating short of wall 54 in a substantially T-shaped configuration having a pair of laterally extending flanges 74 and 76. Lateral sections 64, 66 and 72, along with their associated flanges 68, 70, 74 and 76, extend throughout the entire height of block 50 and are integrally joined to a top matrix layer 78 and an opposing bottom matrix layer (not shown). Walls 54, 56 and 58 are disposed substantially in parallel array with their opposed ends integrally joined to a pair of matrix layers 80 and 82, the latter forming the end walls, with wall 58 forming the front wall of block 50.

Referring again to FIG. 11, the overall strength of block 50 can be still further enhanced by disposing portions of cementitious material having a density intermediate the density range between the higher density matrix and lower density zones within those areas of low density zone 60 bridging the ends of adjacent pairs of flanges 68, 74 and 70, 76. Such portions of cementitious material having an intermediary density are generally designated at 84 and 86, respectively. Portions 84 and 86 may continuously extend between and be integrally joined to opposing top and bottom wall sections of block 50 and, moreover, may be formed from the same basic composition as low density zone 60, which composition is modified by incorporating a higher percentage of cementitious material therein. Portions 84 and 86 may each be of rectangular shape or, if desired, essentially free form in overall configuration.

The internal intersections betwen the adjacent wall sections, lateral sections and flanges of matrix 52 may be provided with angular fillet corners 88 for the purpose of optimizing stress distribution and thereby increase overall strength in these areas.

Figure 12:
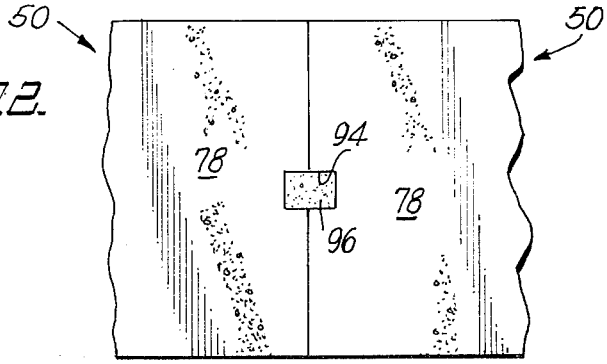
FIG. 12 is a fragmentary plan view of two building elements according to the embodiment of FIG. 10 disposed in interlocking engagement.

As seen in FIGS. 10 and 11, opposing end walls 80 and 82 of matrix 52 may be provided with frangible sections 90 and 92 for the purpose of interlocking adjacent blocks 50 together. This is shown in FIG. 12 wherein two adjacent blocks 50 are disposed in abutting end to end relationship with their respective corresponding adjacent frangible portions 90 and 92 removed. The spaces **90*a* and 92*a* formed by the removal of frangible sections 90 and 92, respectively, cooperatively define a recess 94 having a longitudinal axis which extends from the top to the bottom of adjacent blocks 50. An interlocking member 96 having an exterior configuration corresponding to the interior configuration of recess 94 is inserted into the latter, thereby serving to lock adjacent blocks 50 together against shifting movement. Member 96 may be formed substantially of low density material, such as perlite, but may also include cementitious material so that its density can be varied in accordance with the requirement of any specific application or use. Recess 94 formed by the removal of frangible sections 90 and 92 is depicted as being rectangular in shape, but it is to be understood that recess 94 may assume any desired shape or size simply by varying the configuration of frangible sections 90 and 92**.

Though block 50 has been shown to include a low density zone 62 having a substantially rectangular configuration, it is to be understood that the space defined by zone 62 may be completely or partially devoid of low density material and, moreover, may include one or more partitions serving to subdivide this space into two or more separate chambers. This permits varying the overall weight of block 50 or providing necessary channels therethrough for the passage of electrical wires and plumbing conduits through a wall structure made up of blocks 50.

It is further understood that the constituents and compositional ranges thereof making up matrix 52 and lower density zones 60 and 62 may be the same as that previously indicated for the other embodiments of the invention as depicted in FIGS. 1–9. The inclusion of clay aggregates, such as expanded clay, in matrix 52 serves to considerably enhance the thermal insulation qualities thereof. Moreover, matrix 52 may also include similar reinforcing members embedded therein as previously shown in FIGS. 3–5 for panel embodiment 7.

Several specific modifications of block 50 are shown in FIGS. 13–17, with such modifications being primarily characterized by the absence of top matrix layer 78 and its opposing bottom matrix layer (not shown). Further, frangible sections 90 and 92 have been removed from these modified blocks, with the latter being depicted in substantially final form for actual use.

Figure 13:
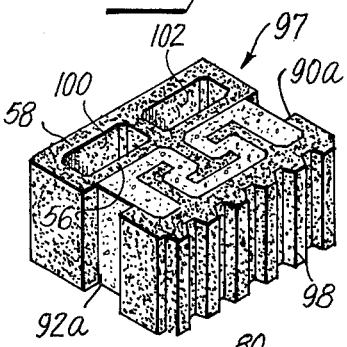
FIGS. 13–17 are isometric views of several modifications of the embodiment depicted by FIG. 10.

The modification of FIG. 13 includes a block 97 provided with a ribbed back wall 98 which serves as a decorative facade when wall 98 is disposed to form part of either an exterior or interior surface of a complete wall assembly. As is apparent, zone 62 of low density material has been omitted and the space normally occupied thereby has been formed into a pair of transverse channels 100 and 102 defined by a matrix wall section 104, the latter integrally bridging exterior wall 58 and interior wall 56. Alternatively, block 97 may be provided with non-ribbed wall 54 of block 50 in substitution for ribbed wall 98.

Figure 14:
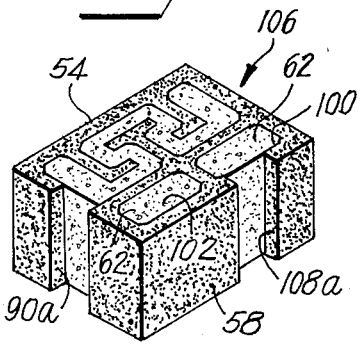

The modification of FIG. 14 includes a block 106 wherein space **92*a* normally formed by the removal of frangible section 92 is omitted and a similar space 108*a* is provided in wall 58. Channels 100 and 102 are filled with low density material 62. The locations of spaces 90*a* and 108*a* in block 106** renders the latter particularly useful as a corner block in a wall assembly.

Figure 15:
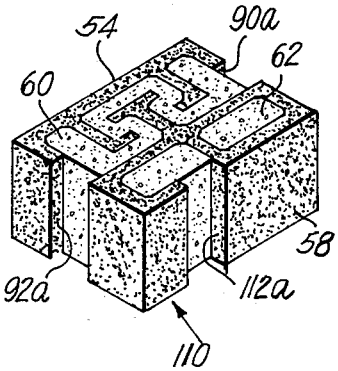

The modification of FIG. 15 is shown as a block 110 which is particularly useful as a partition block in a wall assembly. Block 110 includes, in addition to spaces **90*a* and 92*a*, a third space 112*a* formed in wall section 58**.

Figure 16:
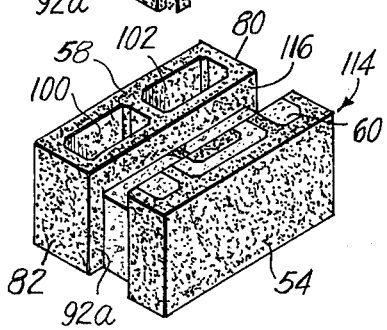

The modification of FIG. 16 comprises a block 114 which has the same physical characteristics of block 97 with the exception that ribbed wall 98 has been replaced by nonribbed wall 54 and a rectangular section of block 114 has been removed to form a top longitudinal channel 116 therethrough. Channel 116 has a width substantially equal to the width of space **92*a* and a length substantially equal to the distance between the opposing interior surfaces of end walls 80 and 82. The presence of channel 116 renders block 114 particularly useful as a lintel block for forming the uppermost peripheral layer of a wall assembly. When a plurality of blocks 114 are disposed in end-to-end abutting relationship, consecutive channels 116** serve to define a continuous channel along the top of a wall assembly for receiving the traditional steel strapping or similar bracing means in lintel fashion.

Figure 17:
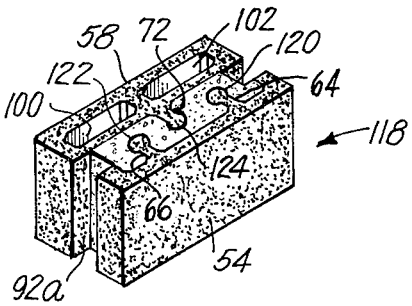

The modification of FIG. 17 includes a block 118 having the same basic characteristics of block 97 with the exception that lateral sections 64, 66 and 72 terminate in ends having substantially rounded or cylindrical-shaped edge portions 120, 122 and 124, respectively. The overall configuration of block 118 is particularly suited for use in making blocks having smaller overall dimensions.

Figure 18:
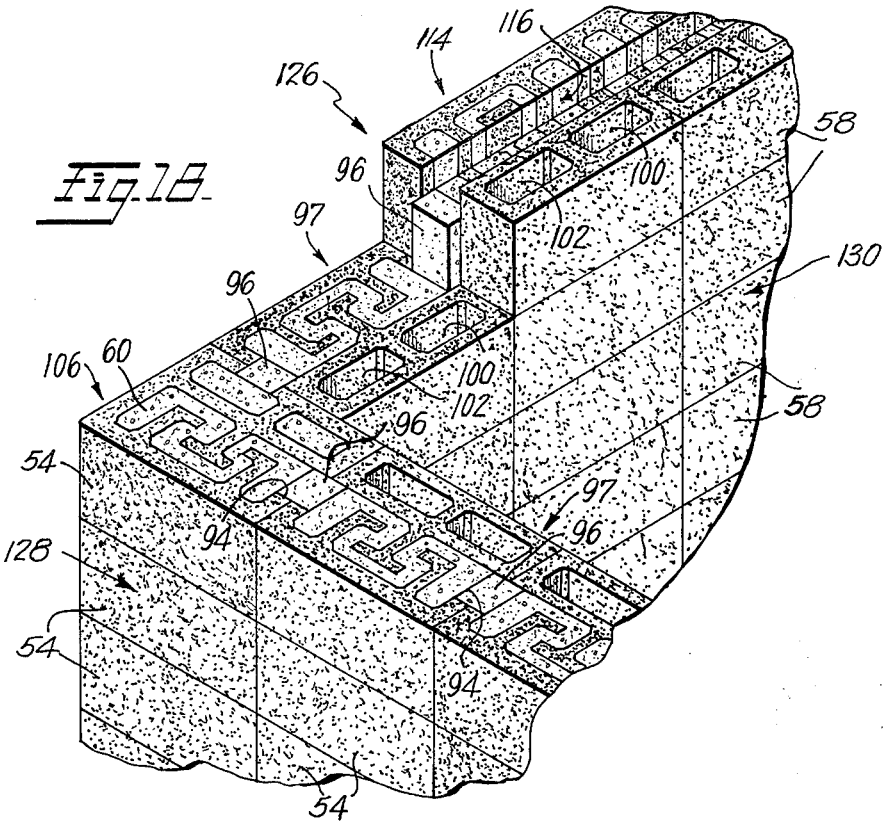
FIG. 18 is a fragmentary isometric view of a wall assembly constructed of the elements of FIGS. 13, 14 and 16.

Referring now to FIG. 18, there is shown a wall assembly 126 constructed from a plurality of blocks 97, 106 and 114 disposed in even vertical stacks or "jack form" and secured together by a plurality of interlocking members 96 being inserted in recesses 94 defined by cooperating spaces 90*a*, 92*a* and 108*a*. The external and internal surfaces of wall 126, generally designated at 128 and 130, respectively, may each be coated with a layer of bonding material, such as fiberglass-reinforced cementitious material, which serves to structurally unify and waterproof wall 126. In this manner, wall 126 may be contructed in the absence of utilizing mortar between the individual blocks, though it is to be understood that mortar may be employed, if desired, for bonding adjacent blocks together.

Because of the continuous convolute or corrugated configuration of lower density zone 60 in block 50 and all the modifications thereof as shown in FIGS. 13–17, it is apparent that the abutting relationships between lower density zone 60 and interlocking members 96, the latter also being formed substantially of the same lower density material, collectively serve to define a substantially continuous "thermal barrier" that extends in both the vertical and horizontal directions to the planar extremities of wall 126. This "thermal barrier" is effectively disposed between exterior and interior surfaces 128 and 130, the latter being formed of matrix or higher density material sections 54 and 58, respectively. Thus, an extremely effective thermal insulation quality is inherent in wall 126, which quality greatly enhances energy conservation in any housing or building structure constructed from the blocks of the present invention.

The primary thermal insulation of wall 126 is derived from the "thermal barrier" formed from low density zones 60 and abutting interlocking members 96, all of which are formed substantially from perlite. However, by incorporating aggregate in the form of clay, such as expanded clay particles, in the composition of matrix sections 54 and 58, an even greater degree of thermal insulation is imparted to exterior and interior walls 128 and 130.

In a preferred embodiment of the present invention, which embodiment is to be understood as exemplary and not limiting, a building element was formed from compositions as follows: For the high density matrix, 2,660 pounds of sand having an ASTM specification of C332 of Group 1 were mixed with 9 sacks of cement (about 94 pounds/sack) and 54 gallons of water. This produced one cubic yard of matrix composition. For the low density zones, 6.75 sacks of cement (about 94 pounds/sack) were mixed with 27 cubic feet of perlite (about 8 pounds/ft.$^3$) and 61 gallons of water to produce one cubic yard of low density zone composition.

The final high density composition was approximately 150 pounds per cubic foot. The final low density composition was approximately 36 pounds per cubic foot. However, by varying the amounts of sand and perlite, the respective preferred high and low densities were ascertained to be on the order of about 90–150 pounds per cubic foot and 22–36 pounds per cubic foot. The overall density of the formed building element will vary, of course, depending upon the configuration and sizes of the low density zones and the thickness of the high density matrix.

A preferred embodiment of a building element utilizing the latter described compositions may assume a generally planar configuration similar to panel 1 of FIG. 1 or panel 7 of FIG. 3. Such preferred embodiment may also assume the basic block configuration depicted by FIG. 10 and its several modifications as shown by FIGS. 13–17. The interconnected matrix, having a density of approximately 150 pounds per cubic foot, substantially completely surrounds the plurality of lower density zones with the latter having a density of approximately 36 pounds per cubic foot. The matrix effectively includes three spaced sections which divide the zones into two portions or tiers. The spaced sections of matrix are continuous and extend to the extremities of the panel in the manner as indicated for panel 1 in FIG. 2, panel 7 in FIG. 5, block 50 in FIG. 10 and modifications of the latter as depicted in FIGS. 13–17.

The building element of the present invention may be made by first individually molding the lower density zones from the desired composition. The molded zones, in the form of blocks or other shapes, are then placed, while still in a "green" state, in a larger mold having the form of the finished element. The zones are spaced from each other and from the walls of the larger mold. The desired matrix composition is then injected into the spaces of the latter mold such that it surrounds and embeds each zone in matrix material and completely fills the spaces. Because the zones are utilized in a "green" condition, the cementitious material in the matrix forms a secure bond with the cementitious material in the zones to thereby create a continuous cementitious phase throughout the entire element.

The building element may also be made by continuously extruding a layer of matrix between and around a succession of zones in the form of blocks or other shapes.

It is to be understood that the forms of the invention herewith shown and described are to be taken as preferred examples of the same, and that various changes in the shape, size and arrangement of parts and compositions may be resorted to, without departing from the spirit of the invention or scope of the subjoined claims.

What is claimed is:

1. A building element comprising:

(a) a continuous phase of cementitious material including:

1. a matrix having a first density, and
2. at least one zone dispersed within the matrix having a second density lower than the first density, wherein said continuous phase of cementitious material extends throughout said matrix and said lower density zone; and wherein (b) the matrix includes a first wall section and a generally parallel and opposing second wall section, said first wall section having at least one first lateral section extending away therefrom at least half the distance between said first and second wall sections but terminating short of said opposing second wall section at a lower density zone disposed between the terminal end of the lateral section and the second wall section, and said second wall section having at least one second lateral section, spaced longitudinally from said first lateral section, extending away therefrom at least half the distance between said first and second wall sections but terminating short of said opposing first wall section at a lower density zone disposed between the terminal end of the lateral section and the first wall section.

2. The element of claim 1 wherein the element is of a substantially rectangular block configuration.

3. The element of claim 2 wherein at least one exterior wall section of the element includes a frangible portion that is removable to define a space for receiving means for interlocking adjacent elements together.

4. The element of claim 3 wherein:
(a) a frangible portion is provided in each of two opposing exterior wall sections, and
(b) each frangible portion has a substantially rectangular configuration that extends for at least a major distance between two opposing extremities of each exterior wall section.

5. The element of claim 1 wherein:
(a) the first wall section is an exterior wall of the element that includes two inwardly directed first lateral sections, and
(b) the second wall section is an interior wall of the element that includes one second lateral section extending away therefrom and terminating short of the first wall section.

6. The element of claim 5 wherein:
(a) the second lateral section is disposed between the first lateral sections, and
(b) each of the first lateral sections terminates in an end having a single flange, with both single flanges being directed in opposite directions towards each other, and
(c) the second lateral section terminates in an end having double flanges that are directed in opposite directions away from each other.

7. The element of claim 6 wherein portions of cementitious material having a third density within the density range of the first and second densities are disposed between the flanges of the first lateral sections and the corresponding adjacent flanges of the second lateral section.

8. The element of claim 1 wherein:
(a) at least two lower density zones are dispersed within the matrix, and
(b) the matrix substantially completely surrounds the lower density zones and defines three continuous spaced layers that extend substantially along the longitudinal axis of the element.

9. The element of claim 1 wherein the transverse cross-sectional configuration of the lower density zone is substantially convolute.

10. The element of claim 1 wherein:
(a) the first density is of a range from about 60 to 200 pounds per cubic foot, and
(b) the second density is of a range from about 10 to 50 pounds per cubic foot.

11. The element of claim 1 wherein the overall average density of the element is of a range from about 20 to 200 pounds per cubic foot.

12. The element of claim 1 wherein:
(a) the matrix has a composition including a continuous phase of cementitious material and a first discontinuous phase selected from the group consisting of aggregate particles, organic fibers, inorganic fibers and mixtures thereof, and
(b) the lower density zone has a composition including a continuous phase of cementitious material and a second discontinuous phase of a filler having a density lower than the density of the cementitious material.

13. The element of claim 12 wherein the filler is selected from the group consisting of perlite, vermiculite, expandable polymers and mixtures thereof.

14. The element of claim 13 wherein:
(a) the matrix has a density of a range of about 90 to 150 pounds per cubic foot and the first discontinuous phase is aggregate, and
(b) each lower density zone has a density of a range of about 22–36 pounds per cubic foot and the second discontinuous phase is perlite.

15. The element of claim 5 wherein:
(a) the second lateral section is disposed between the first lateral sections, and
(b) the first lateral sections and the second lateral section each terminate in an end edge having a substantially cylindrical configuration.

16. The element of claim 2 wherein the matrix includes at least one transverse channel therethrough.

17. The element of claim 16 wherein the matrix includes a bridging portion for subdividing the transverse channel into first and second subsidiary transverse channels.

18. The element of claim 17 wherein each of the subsidiary transverse channels are filled with lower density material.

19. The element of claim 17 further including a longitudinal channel for receiving means for securing a plurality of the elements together.

20. The element of claim 2 wherein one exterior wall of the element includes a ribbed formation.

21. The element of claim 1, wherein the matrix comprises an interconnected matrix.

22. The element of claim 5, wherein
(a) the second lateral section is disposed between the first lateral sections, and
(b) each of the first lateral sections and the second lateral section terminate in an enlarged portion.

23. The element of claim 1, wherein the continuous phase of cementitious material extending throughout said matrix and said lower density zone is produced by substantially simultaneously curing said matrix and said lower density zone.

24. A wall assembly comprising a plurality of longitudinally abutting building elements, wherein each building element comprises:
(a) a continuous phase of cementitious material including:
1. a matrix having a first density, and
2. at least one zone dispersed within the matrix having a second density lower than the first density, wherein said continuous phase of cementitious material extends throughout said matrix and said lower density zone; and wherein
(b) the matrix includes a first wall section and a generally parallel and opposing second wall section, said first wall section having at least one first lateral section extending away therefrom at least half the distance between said first and second wall sections but terminating short of said opposing second wall section at a lower density zone disposed between the terminal end of the lateral section and the second wall section, and said second wall section having at least one second lateral section, spaced longitudinally from said first lateral section, extending away therefrom at least half the distance between said first and second wall sections but terminating short of said opposing first wall section at a lower density zone disposed between the terminal end of the lateral section and the first wall section.

25. The wall assembly of claim 24 wherein:

(a) the abutting exterior walls of adjacent elements each include a space, which spaces cooperate to define a recess, and (b) an interlocking member is disposed within each recess for securing adjacent elements together.

26. The wall assembly of claim 25 wherein the interlocking members are formed of lower density material and directly engage the respective lower density zones of adjacent elements.

* * * * *

UNITED STATES PATENT AND TRADEMARK OFFICE

CERTIFICATE OF CORRECTION

PATENT NO. : 4,288,955

DATED : September 15, 1981

INVENTOR(S) : Carl C. Hiatt et al.

It is certified that error appears in the above—identified patent and that said Letters Patent is hereby corrected as shown below:

On The Title Page, the second inventor's name should read

-- Nils F. Larson --.

Signed and Sealed this

*Second* Day of *March 1982*

[SEAL]

*Attest:*

GERALD J. MOSSINGHOFF

*Attesting Officer*

*Commissioner of Patents and Trademarks*